United States Patent [19]

Wirtz et al.

[11] 4,349,067

[45] Sep. 14, 1982

[54] MACHINE AND METHOD FOR CONTINUOUSLY CASTING BATTERY GRIDS

[75] Inventors: John W. Wirtz; Raymond L. Schenk, both of Port Huron, Mich.

[73] Assignee: Wirtz Manufacturing Company, Inc., Port Huron, Mich.

[21] Appl. No.: 176,479

[22] Filed: Aug. 8, 1980

Related U.S. Application Data

[63] Continuation-in-part of Ser. No. 65,365, Aug. 9, 1979, abandoned.

[51] Int. Cl.[3] ..... B22D 11/10

[52] U.S. Cl. ..... 164/479; 164/429; 164/439; 164/DIG. 1

[58] Field of Search ..... 164/479–482, 164/427–434, 437–440, DIG. 1, 133, 135, 337; 264/328.1, 328.2, 328.11, 328.12, 328.19; 425/555

[56] References Cited

U.S. PATENT DOCUMENTS 3,455,371 7/1969 Nichols et al. ..... 164/482

4,122,890 10/1978 Atkins et al. ..... 164/439 X

FOREIGN PATENT DOCUMENTS 934522 10/1973 Canada ..... 164/479

*Primary Examiner*—R. L. Spruill

*Assistant Examiner*—K. Y. Lin

*Attorney, Agent, or Firm*—Barnes, Kisselle, Raisch & Choate

[57] ABSTRACT

A machine for casting battery grids has a rotary drum, the pattern of the battery grid cavity being recessed into the outer periphery thereof. An arcuate shoe is fixedly positioned against the rotating drum in sliding contact with the outer peripheral surface thereof. The shoe has an internal passageway connected to an orifice slot which extends to the periphery of the drum. The orifice slot is connected at one end to a source of molten lead under pressure and at its other end to a return line. The molten lead in the orifice slot is under superatmospheric pressure. The rate of flow of the molten lead through the orifice slot is in excess of that required to fill the grid cavity.

34 Claims, 13 Drawing Figures

FIG. 5
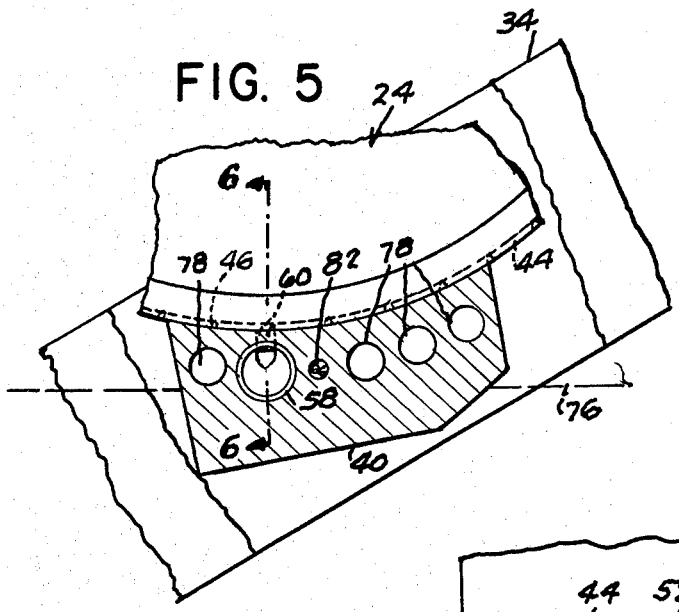
FIG. 6
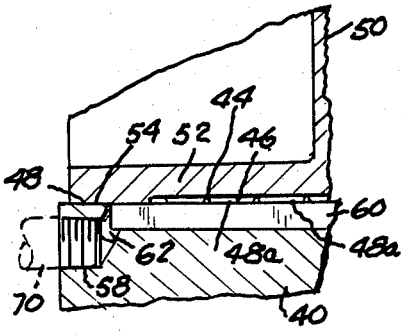
FIG. 7
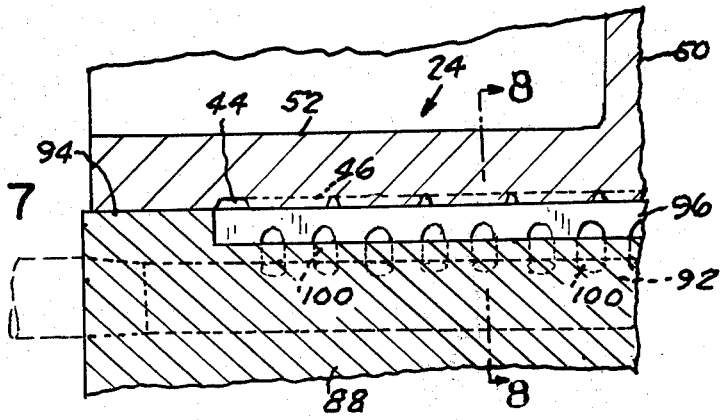
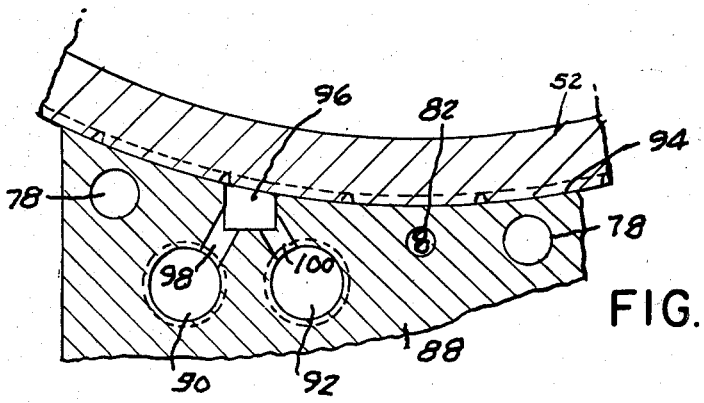
FIG. 8

MACHINE AND METHOD FOR CONTINUOUSLY CASTING BATTERY GRIDS

This application is a continuation-in-part of a prior application Ser. No. 065,365, filed Aug. 9, 1979 and now abandoned.

This invention relates to a battery grid casting machine and method, and, more particularly, to a machine and method for casting battery grids in a continuous manner.

At the present time battery grids are normally cast individually in molds having separable mold sections, the grid pattern cavity being machined as shallow grooves in the opposed faces of the mold sections. The mold faces in which the grid cavity is machined are periodically coated with a thin layer of powdered cork or acetylene smoke which acts as an insulator to prevent the lead from chilling before all of the grooves defining the grid pattern are completely filled. The production of individual battery grids in this manner is a relatively slow process and requires a considerable amount of skill on the part of the operator.

In recent years attempts have been made to cast battery grids in a more rapid, continuous manner utilizing a rotary drum having the desired battery grid pattern cavity machined into the outer peripheral surface of the drum. Such continuous casting machines have presented numerous problems, especially with respect to the difficulty in obtaining complete filling of the shallow grooves forming the grid cavity with molten lead while rotating the drum at a reasonably rapid rate. Because of this and other problems encountered, continuous casting of battery grids with such drums has not enjoyed wide commercial use at the present time.

The primary object of the present invention is to provide a machine and method for casting battery grids in a continuous manner which overcomes the problems heretofore encountered with such methods and machines.

More specifically, it is an object of this invention to provide a machine and method for continuously casting battery grids which utilize a rotary drum having the grid cavity machined in the outer peripheral surface thereof and in which complete and rapid filling of the grid cavity is assured by directing the lead thereto under substantial pressure and in an amount greatly in excess of that required to fill the grid cavity as the drum rotates.

The machine of the present invention includes a shoe having a smooth arcuate surface conforming closely to a relatively short arcuate segment of the outer cylindrical surface of the drum. The shoe is held in fixed position against the outer periphery of the drum while the drum is rotating so as to provide a smooth sliding engagement therewith. An internal passageway in the shoe has an orifice slot which extends to the surface of the drum and has an inlet connected to a source of molten lead under pressure and an outlet connected to a lead return line. The molten metal flowing through the orifice slot is maintained under superatmospheric pressure by restricting the outlet flow or by any other suitable means. This arrangement produces several desirable advantages discussed hereinafter.

Other objects, features and advantages of the present invention will become apparent from the following description and accompanying drawings, in which.

Figure 1:
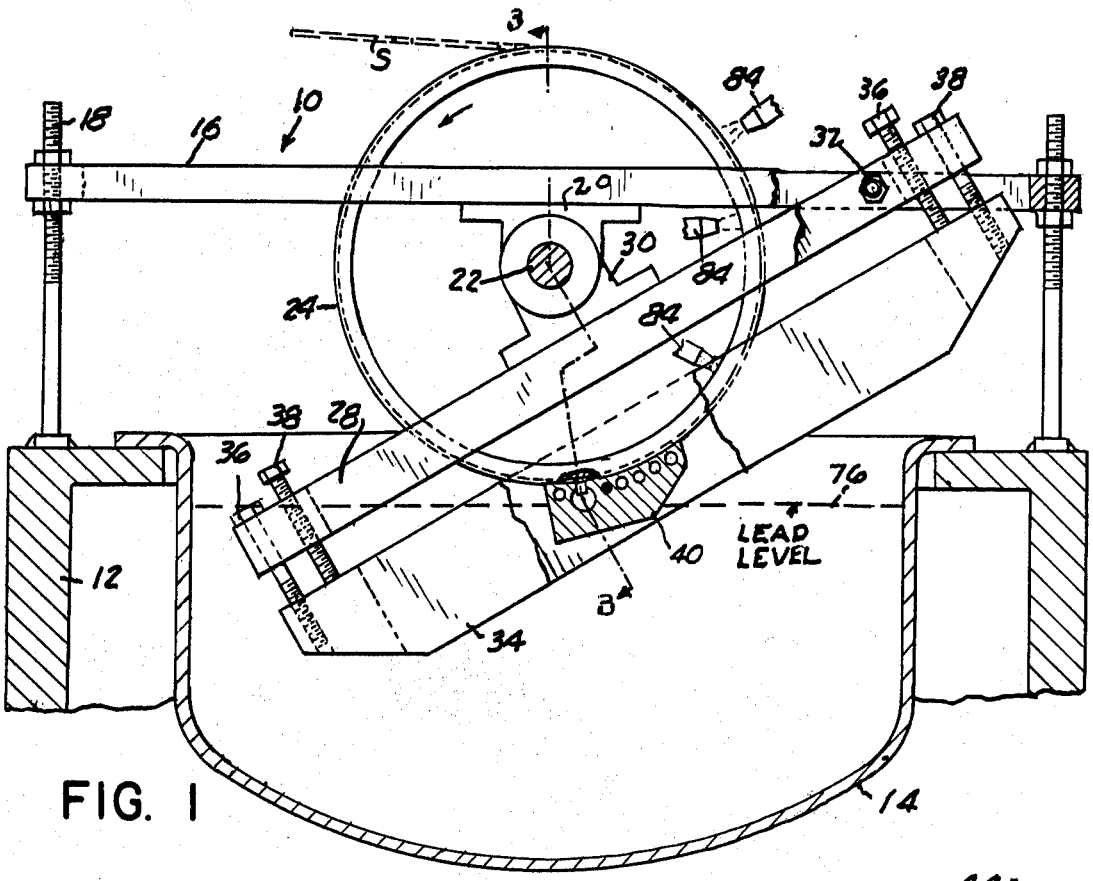
FIG. 1 is a vertical sectional view of a battery grid casting machine according to the present invention taken on a plane transverse to the axis of rotation of the casting drum.
Figure 9:
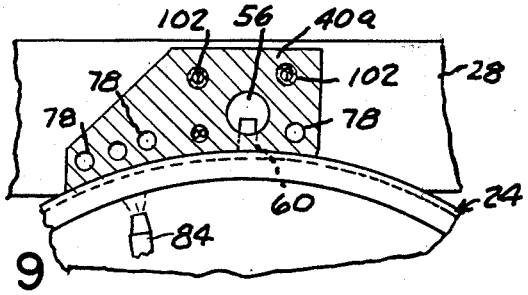
Figure 4:
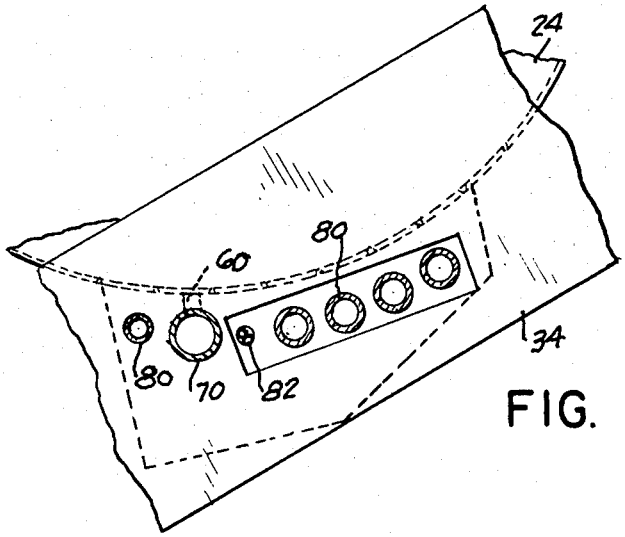
FIG. 4 is a sectional view generally along the line 4—4 in FIG. 3.
Figure 4A:
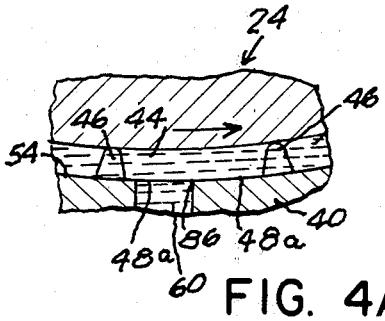
Figure 10:
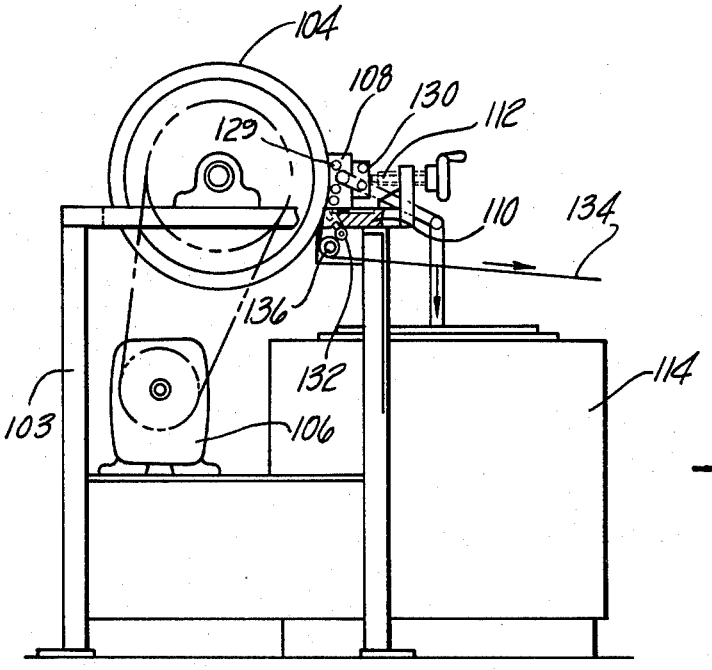
Figure 11:
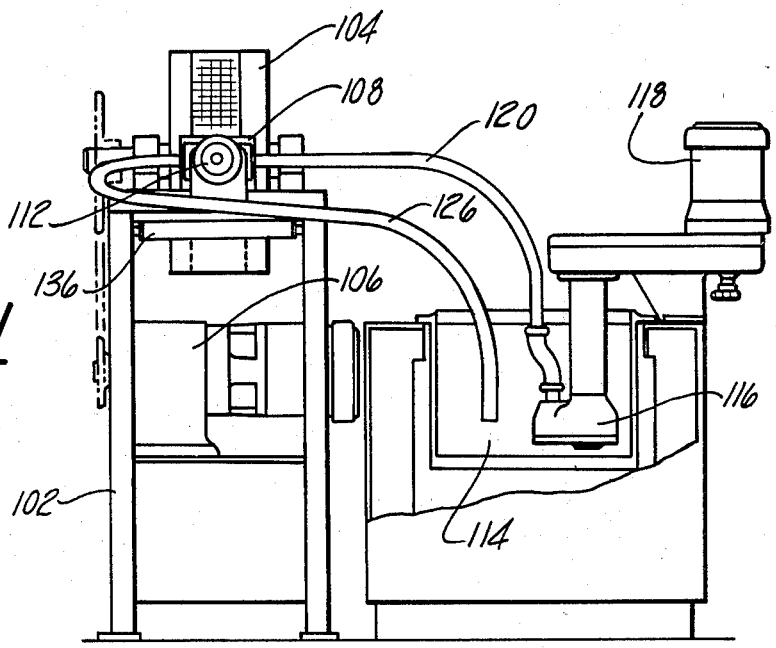

FIG. 4*a* is an enlarged view of a portion of the arrangement shown in FIG. 4;

FIG. 5 is an enlarged sectional view of a portion of the machine shown in FIG. 1;

FIG. 6 is a fragmentary sectional view taken along the line 6—6 in FIG. 5;

FIG. 7 is a sectional view of a modified form of shoe on the machine;

FIG. 8 is a sectional view taken along the line 8—8 in FIG. 7;

FIG. 9 is a fragmentary side elevational view, partly in section, of another modification of the machine;

FIG. 10 is a side elevational view, partly in section, of another form of grid casting machine according to the present invention;

FIG. 11 is an end view of the machine shown in FIG. 10; and

Figure 12:
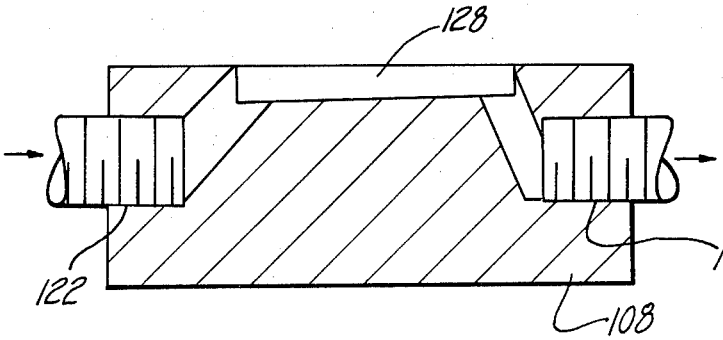

FIG. 12 is a sectional view of the shoe employed in the machine shown in FIGS. 10 and 11.

Figure 3:
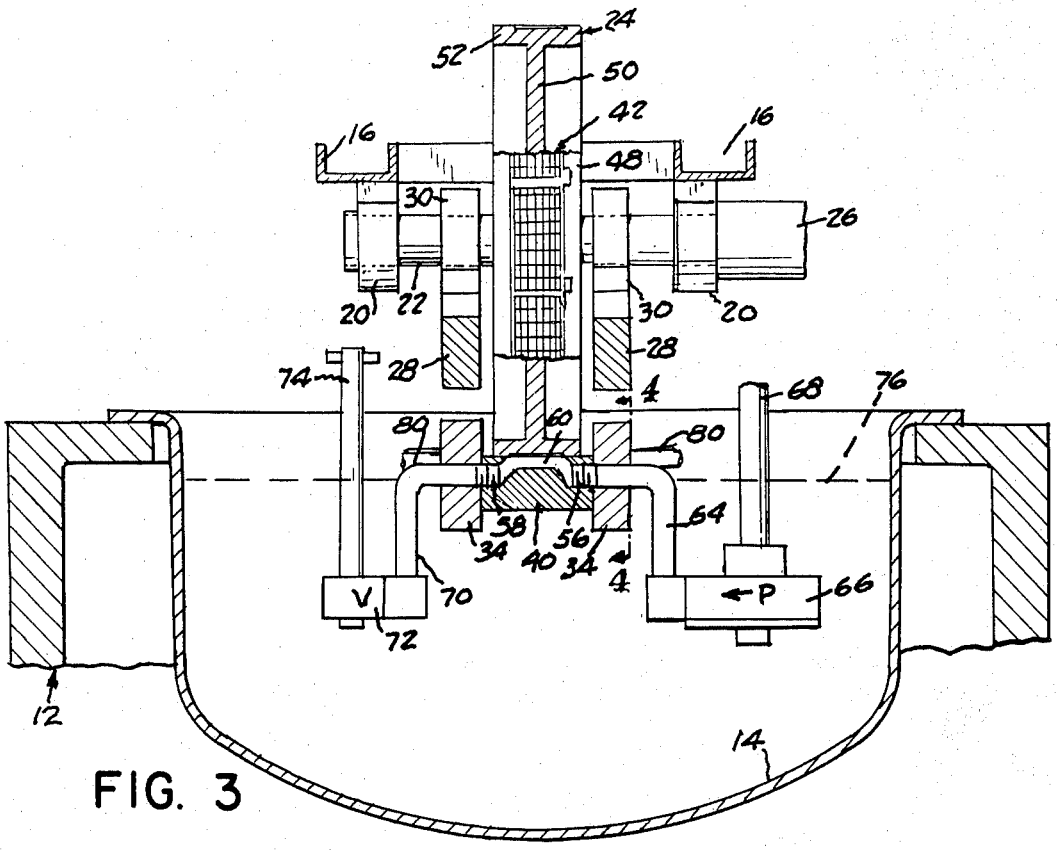
FIG. 3 is a sectional view taken along the line 3—3 in FIG. 1.

Referring first to FIGS. 1 and 3, the machine comprises a supporting frame 10 by means of which it is mounted on the supporting structure 12 of a heated lead pot 14. Frame 10 can be of any suitable construction and, in the arrangement shown, includes a pair of spaced channels 16 supported at their opposite ends for vertical adjustment on upright threaded rods 18. A pair of pillow blocks 20 on channels 16 support a shaft 22 to which a casting drum 24 is keyed. A suitable drive 26 is connected to shaft 22 for rotating drum 24 at the desired speed. In the arrangement shown in FIG. 1 drum 24 is rotated in a counterclockwise direction.

A pair of support bars 28 is mounted on shaft 22 at opposite sides of drum 24 by means of pillow blocks 30. Each support bar 28 has one end thereof fixed to its adjacent channel 16 at a desired angle of inclination by a screw 32. A pair of laterally spaced guide bars 34 is mounted on support bars 28 by screws 36,38 which enable the guide bars 34 to be adjusted toward and away from support bars 28. Between guide bars 34 there is mounted a shoe 40.

Figure 2:
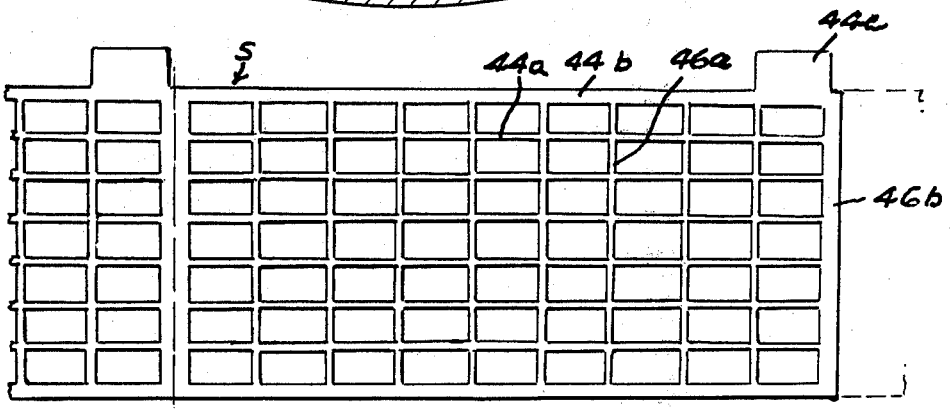
FIG. 2 is a plan view of a portion of the continuous battery grid strip cast in the machine.

The desired pattern of the battery grid cavity 42 is machined in the smooth outer cylindrical surface of drum 24. This grid pattern comprises a plurality of circumferentially extending grooves 44 and a plurality of transversely extending grooves 46. Grooves 44 are adapted to form the longitudinally extending wires 44*a*,44*b* and the transverse grooves 46 are adapted to form the transverse wires 46*a*,46*b* of the finished grid shown in FIG. 2. The wires 44*b* and 46*b* are normally wider than the wires 44*a* and 46*a* and form the outer framework of the finished grid. At one side of the grid the groove 44 is enlarged to form the conventional solder lug 44*c* adjacent one end of each grid. At each side thereof the grid cavity terminates inwardly from the side edges of drum 24 so that the laterally outer edge portions 48 of the drum 24 are in the form of smooth, continuous, cylindrical surfaces which lie in the same cylindrical surface as the pads 48*a* bounded by grooves 44,46. In the embodiment illustrated the drum 24 comprises a central web 50 with a cylindrical flange 52 extending around the periphery thereof. The grid cavity 42 is machined around the outer face of flange 52.

Shoe 40 is in the form of a block of metal having a smooth curved surface 54 which conforms closely to and which is in sliding engagement with a relatively short, arcuate segment, for example, 25° to 30°, of the outer cylindrical surface portions 48,48*a* of drum 24. A smooth sliding engagement between the curved surface 54 of shoe 40 and the outer peripheral surface of the drum 24 is obtained by the adjustment of screws 36,38. In the embodiments illustrated in FIGS. 1 through 6 and 9 shoe 40 has an inlet 56 at one side thereof and an outlet 58 at the opposite side thereof. An internal orifice slot 60 extending transversely across shoe 40 and open at the curved surface 54 thereof extends between inlet 56 and outlet 58. Orifice slot 60 is of smaller cross section than the inlet and the outlet and is connected thereto at its opposite ends by upwardly angled passageways 62. As shown in FIG. 6, the orifice slot 60 is co-extensive in a direction transversely of drum 24 with the grid cavity 42 therein. As shown in FIG. 3, a conduit 64 extends downwardly from inlet 56 into the molten lead in pot 14 and is connected with the outlet of a pump 66. A suitable drive shaft 68 extending upwardly from the pump is provided for driving the pump at the desired speed. A similar conduit 70 extends downwardly into the lead pot 14 from outlet 58 and discharges into the lead pot through a restricting valve 72, the amount of restriction provided by valve 72 being adjustable by control rod 74. Valve 72 allows adjustment of the rate of lead flow and back pressure in orifice slot 60.

The liquid level in lead pot 14 is designated by the broken line 76. It will be noted that the lower portion of drum 24 is spaced above the lead level 76 and that the shoe 40 is partially submerged within the lead in pot 14. Shoe 40 is provided with a plurality of coolant passageways 78, each of which is located above the lead level 76. In the arrangement shown three such passageways 78 extend transversely through shoe 40 downstream of orifice slot 60 and one such passageway 78 extends transversely through shoe 40 upstream of orifice slot 60. The upstream coolant passageway 78 is provided to prevent molten lead from flowing in a clockwise direction from orifice slot 60 and discharging from between the drum and the upstream end of shoe 40. The terms "upstream" and "downstream" are used with reference to the direction of rotation of drum 24. Passageways 78 are connected by suitable piping 80 for conducting coolant (such as water) through shoe 40. A thermocouple is also preferably located in shoe 40 within a thermocouple recess 82.

In operation drum 24 is rotated at a desired speed and pump 66 is operated to provide a continuous supply of molten lead alloy (for example at 700°-800° F.) to inlet 56. The interior of the drum flange 52 is preferably cooled by air nozzles 84 so that the casting surface of the drum will be maintained at a temperature (for example 400°-500° F.) substantially below the solidification temperature of the alloy being cast. Thus, the molten lead directed into orifice slot 60 through inlet 56 from pump 66 is quickly chilled as it comes into contact with the surfaces 48,48*a* and the grooves 44,46 on the outer surface of drum 24. Since the drum is rotating in a counterclockwise direction, the lead which tends to solidify on the surfaces 48,48*a* is scraped off of these surfaces by the downstream edge 86 of orifice slot 60 and tends to accumulate along this edge. However, since the molten lead directed through the orifice slot 60 by pump 66 is far in excess of that required to fill the adjacent portion of the rotating cavity, the continuous stream of lead flowing through orifice slot 60 is maintained at a relatively high temperature sufficient to melt, break-up or remove the solidified lead scraped from the surface of the drum. This rapid and continuous flow of high temperature molten lead through the orifice slot 60 thus prevents the solidified lead from building up along the edge 86 and thereby prevents clogging of the orifice slot 60. In addition, since valve 72 provides a restriction for the free flow of lead back to the lead pot through outlet 58, the lead in orifice slot 60 is maintained at a desirably high, superatmospheric pressure. This pressure is sufficient to continuously feed and force molten lead into the portions of grooves 44,46 that have rotated upwardly past orifice slot 60. This assures a final and complete filling of the grooves 44,46 even if the grooves have voids therein after they rotate past the orifice slot 60. Thus, the combination of the excessive lead flow and the superatmospheric pressure on the lead being directed into the grid cavity assures complete filling of the successive portions of the grid cavity while still maintaining a very rapid chill within the grooves. The rapid chill results in a very fine and uniform grain structure in the lead alloy. This very fine grain structure is excellent in cast battery grids because of its resistance to corrosion.

As the filled portions of grooves 44,46 rotate upwardly in a counterclockwise direction they advance along the portion of shoe 40 cooled by the coolant passageways 78 on the downstream side of orifice slot 60. Thus, the temperature of the lead in these grooves is progressively lowered such that, as it emerges from the downstream end of the shoe, the lead has solidified into a continuous strip having the battery grid pattern. The strip S is preferably stripped from the top side of the drum so that it will have cooled to a sufficiently low temperature to assume a sufficiently rigid condition to permit easy handling. The grid strip is cooled substantially after it emerges from between the shoe and drum by the nozzles 84 which direct streams of air against the interior and exterior surfaces of flange 52 as these surfaces rotate past the shoe and before the grid is stripped therefrom. Thereafter, strip S is advanced to a die (not illustrated) which shears it into individual battery grids.

In a typical machine according to the present invention the drum has a diameter of about 18 inches, a width of about $3\frac{1}{4}$ inches and is rotated at about 20 R.P.M. to produce a lineal speed of 94 feet per minute. The battery grids are cast from a lead alloy containing about 0.09% Ca and 0.3% Sn and have a length of $5\frac{1}{2}$ inches, a width of 2 inches and a thickness of 0.035 inches. Each grid weighs about 18 grams and the grid strip weighs about 0.085 pounds per foot. At a lineal speed of 94 feet per minute the grid strip uses about 8 pounds of alloy per minute. Pump 66 has a capacity of about 45 pounds per minute and can be operated at full capacity or its inlet can be adjusted so that the pump delivers somewhat less than its full capacity depending upon the setting of restrictor valve 72. The shoe 40 has a length of about 4 inches and a width of about $3\frac{1}{4}$ inches. The orifice slot 60 has a width of about $\frac{3}{8}$ inches, a depth of about 5/16 inches and is located about 1 inch from the upstream end of the shoe.

The lead pot is heated to a temperature of between 750° to 800° F. With cooling water at about 70° F. and the air nozzles as shown, the temperature of the shoe stabilizes at about 575° F. and at the outer surface of the drum at about 450° F.

While these relative dimensions and other parameters are given by way of example and are not critical, several basic considerations are important. For example, it is very important to maintain a close sliding fit between the curved surface 54 of the shoe 40 and the outer peripheral surface of the drum. Since the temperature of the shoe differs substantially from the temperature of the drum and since the temperatures of each vary somewhat at different sections thereof, the length of shoe 40 should be maintained at a minimum consistent with relatively fast solidification of the grid strip in order to assure close sliding contact between them. Furthermore, a longer shoe requires the application of a greater clamping force to the drum to obtain the proper close fit therebetween and results in excessive friction. A relatively narrow orifice slot is also desirable to prevent the temperature of the drum from becoming excessively high at the section thereof contacting the shoe. Furthermore, it is important that the upstream end of the shoe and the portion of the drum in contact therewith be maintained at temperatures sufficiently low to prevent the pressurized molten lead from leaking out therebetween. The amount of molten lead delivered by the pump must be sufficiently in excess of the amount required to fill the grid cavity to maintain the temperature of the lead in the orifice slot sufficiently high to melt and wash away the lead that solidifies against the outer smooth surface portions of the drum. In addition, the pressure on the molten lead in the orifice slot must be sufficiently high to force the lead up into any voids or past any lead blockages that might occur in the cavity grooves 44,46 as they rotate upwardly past the orifice slot.

The shoe 88 shown in FIGS. 7 and 8 differs only slightly from shoe 40 previously described. In shoe 88 two molten lead passageways 90,92 extend transversely through the shoe. At one end these passageways are plugged. At the opposite end one of these passageways is connected to an inlet pipe extending from pump 66 and the other passageway is connected to an outlet pipe extending to the restriction valve 72. At the curved surface 94 of the shoe 88 an orifice slot 96 similar to orifice slot 60 is machined. However, orifice slot 96 is closed at its opposite ends. A plurality of two sets of oppositely inclined passageways 98,100 extend, respectively, from passageways 90,92 to the orifice slot 96. Thus, referring to FIG. 8 and assuming that passageway 90 is in the inlet passageway and passageway 92 is the outlet passageway, the molten lead is directed as a continuous stream which flows upwardly through the inclined passageways 98 into the orifice slot 96 and then downwardly from orifice slot 96 into the discharge passageway 92 and back to the lead pot through the restriction valve 72. It will be observed that, whether the lead passageways through the shoe are formed in the manner illustrated in FIGS. 1 through 6 or in the manner illustrated in FIGS. 7 and 8, the orifice slot is connected in series relation with the inlet and the outlet of the lead recirculation path. Thus, the hot molten lead continuously recirculates throughout the entire length of the orifice slot. This constant flow of molten lead at high temperature and superatmospheric pressure prevents excessive chilling and lead build up on the localized surfaces of the drum against which the molten lead is directed. It also insures that the solidified lead scraped off the drum by the downstream edge of the orifice slot will be melted, broken up or otherwise removed to prevent clogging of the orifice slot and incomplete filling of the grooves forming the battery grid cavity.

The arrangement shown in FIG. 9 differs from that shown in FIG. 1 in that the shoe **40*a* is located at the top side of drum 24 rather than at the bottom side thereof. When the shoe is located so that it is not partially submerged in the molten lead in pot 14, the temperature thereof is maintained at the desired value required by means of auxiliary heaters 102. In other respects the construction and operation of the modification shown in FIG. 9** are substantially the same as in the embodiments previously described.

Another form of casting machine according to the present invention is illustrated in FIGS. 10 through 12. This machines includes a frame 103 on which the grid casting drum 104 is journalled for rotation about a horizontal axis, the drum being rotated at the desired speed by a motor 106. The shoe 108, which is located at approximately the three o'clock position against the peripheral surface of the drum, is supported on a slide base 110 and is urged against the periphery of the drum with the desired pressure by means of a screw 112. Within the lead pot 114 there is arranged a pump 116 driven by a variable speed motor 118. The outlet of pump 116 is connected by a feed line 120 with the inlet 122 of the shoe 108. The outlet 124 of shoe 108 has a return line 126 connected thereto which extends back to the lead pot 114. The construction of shoe 108 is generally the same as the shoes previously described except that the orifice slot 128 tapers to a progressively diminishing cross section from the inlet 122 to the outlet 124. The progressively decreasing cross section of orifice slot 128 serves to maintain the pressure of the molten lead in the orifice slot at the desired superatmospheric pressure. A heater block 130 on the rear face of shoe 108 contains two electrical heating elements, one located above and the other below orifice slot 128. Coolant passageways 129 are arranged one upstream and two downstream of orifice slot 128. A water spray pipe 132 may be positioned directly below the shoe 108 to assist in rapid solidification of the grid on the downstream side of the shoe. The finished continuous grid, which is designated 134, is stripped from the drum by directing it around a roller 136 located slightly below spray pipe 132. Drum 104 is maintained at the desired temperature by suitable heaters (not illustrated). The machine illustrated in FIGS. 10 through 12 operates in substantially the same manner as the previously described machine except that the molten lead is maintained at the desired superatmospheric pressure by the tapering cross section of orifice slot 128 rather than by a restrictor valve such as shown at 72 in the machine previously described. Any other suitable means may be employed for maintaining the molten metal in the orifice slot at the desired superatmospheric pressure.

In each of the embodiments illustrated it will be noted that the drum is located out of contact with the molten lead in the lead pot. This is desirable not only from the standpoint of maintaining the drum at a desirably low temperature to produce rapid solidification, but also because, if the drum is wetted by the lead bath, oxides and other contaminants form, collect or build up on the outer peripheral surface of the drum. It will also be noted that the lead flows between the lead pot and the orifice slot in the completely closed path. This substantially completely eliminates the tendency for the formation and entrainment of oxide films and particles in the molten metal being cast.

We claim:

1. A machine for continuously casting battery grids comprising a rotary drum having a cylindrical outer surface, said outer surface having a cavity therein conforming to the desired battery grid pattern, a fixedly supported shoe having an arcuate surface thereon extending around an arcuate segment of the outer cylindrical surface of the drum in close fitting, sliding relation, said shoe overlying said cavity and having an inlet and an outlet therein for molten lead, a passageway in said shoe extending between said inlet and said outlet, a portion of said passageway comprising an orifice slot extending to said arcuate surface and communicating with a circumferential segment of the outer peripheral surface of the drum in which said cavity is formed, a pot for molten lead, means for directing molten lead under superatmospheric pressure from said lead pot to said inlet in an amount substantially in excess of that required to progressively fill said cavity as the drum rotates past said orifice slot, means for directing the excess molten lead from said outlet back to said lead pot so that a substantial quantity of molten lead is continuously recirculated between said lead pot and the orifice slot to maintain the lead throughout the orifice slot at a relatively high casting temperature and flow restricting means for preventing free flow of molten lead from said orifice slot back to said lead pot to thereby maintain the molten lead in said orifice slot at said superatmospheric pressure.

2. A machine as called for in claim 1 wherein said drum is located such that its peripheral surface is out of contact with the lead in the lead pot.

3. A machine as called for in claim 1 wherein said drum and shoe are located such as to be out of contact with the lead in said lead pot and including means for maintaining the shoe at a selected elevated temperature to maintain the lead in said orifice slot at a desired casting temperature and means for maintaining the peripheral surface of the drum at a substantially lower temperature to promote relatively rapid progressive solidification of the lead in said cavity as the drum rotates.

4. A machine as called for in claim 1 wherein the drum is located such that its peripheral surface is out of contact with the lead in the lead pot and said shoe is located such that it is at least partially submerged in the lead in said lead pot.

5. A machine as called for in claim 4 wherein said inlet and outlet are disposed at least partially below the level of the molten lead in the lead pot.

6. A machine as called for in claim 1 wherein the portion of the orifice slot at the peripheral surface of the drum is disposed above the level of the molten lead in the lead pot.

7. A machine as called for in claim 1 wherein said drum is mounted for rotation about a horizontal axis and said shoe is located at the lower side of said drum, said shoe being partially submerged in said lead pot, the circumferentially opposite end portions of said shoe which engage the peripheral surface of the drum being spaced above the level of the molten lead in the lead pot.

8. A machine as called for in claim 1 wherein said orifice slot extends transversely across the peripheral surface of the drum and is coextensive with a transversely extending circumferential segment of the cavity.

9. A machine as called for in claim 8 wherein said orifice slot is connected in series relation with said inlet and said outlet to assure a continuous flow of molten lead throughout the length of the orifice slot.

10. A machine as called for in claim 1 wherein said orifice slot extends transversely across the peripheral surface of said drum and is located between the circumferentially opposite ends of said shoe.

11. A machine as called for in claim 10 wherein the orifice slot is located circumferentially substantially closer to the upstream end of the shoe than the downstream end of the shoe relative to the direction of rotation of the drum.

12. A machine as called for in claim 11 including means for cooling the upstream end portion of the shoe to prevent the egress of lead from between the drum and the upstream end of the shoe.

13. A machine as called for in claim 12 including means for cooling the downstream end portion of the shoe to a greater extent than the upstream end portion thereof.

14. A machine as called for in claim 10 wherein said inlet is connected to one end of the orifice slot and the outlet is connected to the opposite end of the orifice slot.

15. A machine as called for in claim 10 wherein said passageway comprises two sections spaced circumferentially of the drum and extending transversely across said shoe, one of said sections being connected to said inlet and the other section being connected to said outlet, and passageway means connecting said orifice slot in series relation with said two sections so that the molten lead flows successively from said inlet into one of said sections, then into the orifice slot and, finally, into the section communicating with said outlet.

16. The method of continuously casting battery grids around a rotating cylindrical drum having a battery grid cavity formed in the outer peripheral surface thereof by directing molten lead from a lead pot to successive segments of the peripheral surface of the rotating drum through an orifice slot in a fixed shoe having a curved surface conforming to and positioned against the periphery of the drum in close sliding engagement which includes the steps of continuously directing molten lead to said orifice slot in an amount substantially in excess of that required to fill the portion of the cavity rotating past the orifice slot, causing the excess molten lead to flow back to the lead pot and maintaining the molten lead in the orifice slot and said cavity at a pressure substantially above atmospheric.

17. The method called for in claim 16 wherein the lead is directed from the lead pot to the orifice slot in a closed path.

18. The method called for in claim 17 where the lead is directed back to the lead pot in a substantially closed path.

19. The method called for in claim 16 wherein the drum is maintained out of physical contact with the molten lead at the lead pot.

20. The method called for in claim 19 wherein a portion of the shoe is submerged in the molten lead of the lead pot and is heated thereby and including the step of cooling the portion of the shoe adjacent the periphery of the drum.

21. The method called for in claim 16 including the step of cooling said shoe on both the upstream and downstream sides of the orifice slot.

22. The method called for in claim 21 wherein the shoe is cooled on the downstream side of the orifice slot, relative to the direction of rotation of the drum, to a greater extent than on the upstream side thereof.

23. A machine for continuously casting battery grids comprising a rotary drum having a cylindrical outer surface, means for rotating the drum in one direction at a predetermined speed, said outer surface having a cavity recessed therein which conforms to the desired battery grid pattern, a fixedly supported shoe having an arcuate surface thereon extending around a relatively short, arcuate segment of the outer cylindrical surface of the drum in close fitting sliding relation, said shoe having a passageway therein for molten lead, a portion of said passageway comprising an orifice slot extending directly to and transversely of said arcuate surface and communicating with a circumferential segment of the peripheral surface of the drum across substantially the full width of the grid cavity, a pot of molten lead, means for directing molten lead from said pot to said passageway in an amount substantially in excess of that required to progressively fill the grid cavity as the drum rotates past the orifice slot, means for directing the excess lead from the passageway back to the lead pot, means for maintaining the molten lead in the orifice slot at superatmospheric pressure to insure complete filling of the grid cavity, means for maintaining the outer peripheral surface of the drum at an elevated temperature sufficiently below the melting temperature of the lead so that a portion of the lead tends to solidify against the periphery of the rotating drum within the circumferential extent of the orifice slot, the downstream side of the orifice slot being defined by a transversely extending edge adapted to scrap the solidified lead from the outermost surface of the drum and means for causing the molten lead to flow through the orifice slot at a sufficiently high velocity to at least partially remelt and wash away the lead accumulating at said downstream edge of the slot for return to the lead pot.

24. A machine as called for in claim 23 wherein said means for maintaining the lead in the orifice slot at superatmospheric pressure comprises flow restricting means for preventing free flow of the lead from the orifice slot back to the lead pot.

25. A machine as called for in claim 23 wherein both the drum and shoe are located such as to be out of physical contact with the lead in the lead pot and means for maintaining the shoe at a selected elevated temperature to maintain the lead in the orifice slot at a desired casting temperature and means for maintaining the peripheral surface of the rotating drum at a sufficiently low temperature to promote relatively rapid and complete solidification of the lead in the portion of the grid cavity extending between the downstream edge of the orifice slot and the downstream end of the shoe.

26. A machine as called for in claim 23 wherein said passageway has an inlet and an outlet connected in series relation with said orifice slot to assure a continuous flow of molten lead throughout the length of the orifice slot.

27. A machine as called for in claim 23 wherein the orifice slot extends transversely of the shoe at a location closer to the upstream end of said arcuate surface than the downstream end of said surface.

28. A machine as called for in claim 27 including means for cooling the upstream end portion of the shoe to prevent egress of lead from between the drum and the upstream end of the shoe and means for cooling the downstream end portion of the shoe to a greater extent than the upstream end portion of the shoe.

29. A machine as called for in claim 23 wherein said arcuate surface subtends an arc of about 25° to 30°.

30. The method of continuously casting battery grids around a rotating cylindrical drum having a grid cavity recessed into the outer peripheral surface thereof by directing molten lead from a lead pot to successive segments of the peripheral surface of the rotating drum through an orifice slot in a fixed shoe having a relatively short, circumferentially extending curved surface conforming to and positioned against the periphery of the drum in close sliding engagement, said slot extending transversely across substantially the entire width of the grid cavity directly adjacent the periphery of the drum, which includes the steps of continuously directing molten lead through said shoe to said orifice slot and into the portion of the grid cavity rotating past the slot in an amount substantially in excess of that required to fill said portion of the cavity; maintaining the lead in said slot at superatmospheric pressure to insure complete filling of the grid cavity; controlling the temperature of the drum so that a portion of the lead tends to solidify against the periphery of the rotating drum within the circumferential extent of the orifice slot; causing the downstream edge of the slot to scrap the solidified lead from the outermost surface of the drum; directing the molten lead through the slot at a sufficiently high velocity to at least partially remelt and wash away the lead accumulating at the downstream edge of the slot; and causing the excess molten lead to flow back to the lead pot.

31. The method called for in claim 30 wherein said lead in said slot is maintained at superatmospheric pressure by restricting the free flow therethrough.

32. The method called for in claim 30 including the step of cooling the drum to a sufficiently low temperature to insure rapid and complete solidification of the battery grid as it emerges from the downstream end of the shoe.

33. The method called for in claim 30 wherein the drum and shoe are maintained out of physical contact with the lead in the lead pot.

34. The method called for in claim 33 wherein the orifice slot is located circumferentially between the upstream and the downstream ends of the shoe and including the step of cooling the shoe on both the upstream and the downstream sides of the orifice slot, the shoe being cooled on the downstream side of the orifice slot to a greater extent than on the upstream side thereof.

* * * * *